US005503058A

United States Patent [19]

Marinos

[11] Patent Number: 5,503,058

[45] Date of Patent: Apr. 2, 1996

[54] VECTORED PLASMA ARC DEVICE

[75] Inventor: Charalampos D. Marinos, Brooklynn Center, Minn.

[73] Assignee: FMC Corp., Chicago, Ill.

[21] Appl. No.: 167,300

[22] Filed: Dec. 16, 1993

[51] Int. Cl.[6] ..... F41B 6/00

[52] U.S. Cl. ..... 89/8; 102/202.7

[58] Field of Search ..... 89/8; 102/202.7, 102/305, 372, 375

[56] References Cited

U.S. PATENT DOCUMENTS

| | | | |
|---|---|---|---|
| 317,409 | 5/1885 | Monfort | 102/472 |
| 4,325,305 | 4/1982 | Pastine | 102/305 |
| 4,534,263 | 8/1985 | Heyne et al. | 89/8 |
| 4,621,577 | 11/1986 | Bickes et al. | 89/8 |
| 4,961,366 | 10/1990 | Kemeny | 89/8 |

FOREIGN PATENT DOCUMENTS

| | | | |
|---|---|---|---|
| 259396 | 10/1990 | Japan | 89/8 |
| 2233076 | 1/1991 | United Kingdom | 89/8 |

OTHER PUBLICATIONS

Grob, Bernard, Basic Electronics, "15–1 Magnetic Field Arand an Electric Current", 1984, pp. 286–287.

*Primary Examiner*—Stephen C. Bentley

[57] ABSTRACT

This disclosure relates to a method and device in which plasma arc is vectorally mobilized to ignite and create a moving burning propellant front such that high muzzle velocities are attained under low pressures. Primarily, electromagnetic forces are used to impart direction and velocity to an ionized conductive plasma arc mass in an electrothermal-chemical cartridge. The plasma arc mass is electromagnetically directed and accelerated through a combustion chamber and a gun tube thus imparting a traveling constant pressure and thrust behind a projectile to thereby yield very high muzzle velocities.

10 Claims, 1 Drawing Sheet

VECTORED PLASMA ARC DEVICE

BACKGROUND OF THE INVENTION

Field of the Invention

The present invention relates to vectored plasma arc devices and method to electromagnetically direct and urge plasma arc and the attendant combustive constituents to travel in a containment structure to provide higher pressure than conventional or electrothermal-chemical guns behind a projectile.

SUMMARY OF THE INVENTION

The invention relates to an electromagnetically vectored plasma arc device and method. Generally, cartridges used in Electrothermal-chemical gun systems require high muzzle energy yields to accelerate projectiles. One of the many major problems in electrothermal and electrothermal-chemical guns is high pressure encountered in the combustion chamber. Specifically, the confines of most combustion chamber are such that high pressure creation and buildup are unavoidably persistent primarily because of the lack of expansion space. High pressure is a limiting factor to achieving high muzzle energies. Prior techniques to overcome this problem include using large combustion chambers. However, such combustion chambers are cumbersome and consume scarce volume and add weight to the gun system. Incorporating fuel in a cavity within the projectile is another approach. In that design, the fuel is expelled from the projectile cavity and is burned down bore thus providing additional thrust to the projectile, without increasing the combustion chamber pressure. However, since a propellant with a very fast burning rate is needed, problems such as ignition and timing are encountered thus yielding poor results.

The present invention proffers a significant advance over the prior art in that it combines electrothermalchemical and electromagnetic technologies. Unlike the prior an, the fuel in the vectored plasma arc device is not carried down bore by the projectile but is pushed in the gun barrel by an electromagnetic force similar to the force applied on a rail gun armature. One of the many distinguishing features of the present invention include a unique method for coupling the electric energy. In lieu of a capillary structure, the present invention incorporates rails which comprise power and ground rails. Specialized geometric shapes of the rails and electrodes enable electromagnetic forces to be exerted on the plasma. These forces pull the plasma forward toward the projectile which in turn pushes burning propellant in the gun barrel thus providing high pressure down bore. Further, the organization of the elements is such that both structural simplicity and weight savings are realized over the prior art.

Specific advances, features and advantages of the present invention will become apparent upon examination of the following description and drawings dealing with several specific embodiments thereof.

DESCRIPTION OF THE PREFERRED EMBODIMENT

The vectored plasma arc devices of the present invention incorporate the advantages of electrothermal-chemical combustion with electromagnetic force. One of the objects is to vector plasma arc down a gun tube such that an ignited propellant stored between the plasma arc and a projectile will be sweeped and pushed forward. The plasma arc travels under the influence of electromagnetic forces, generated as a result of current flow in a parallel rail system, which provide both direction and velocity magnitude to vector the plasma arc. The embodiment of the present invention is supplied with each unit of an electrothermal-chemical cartridge.

Figure 1:
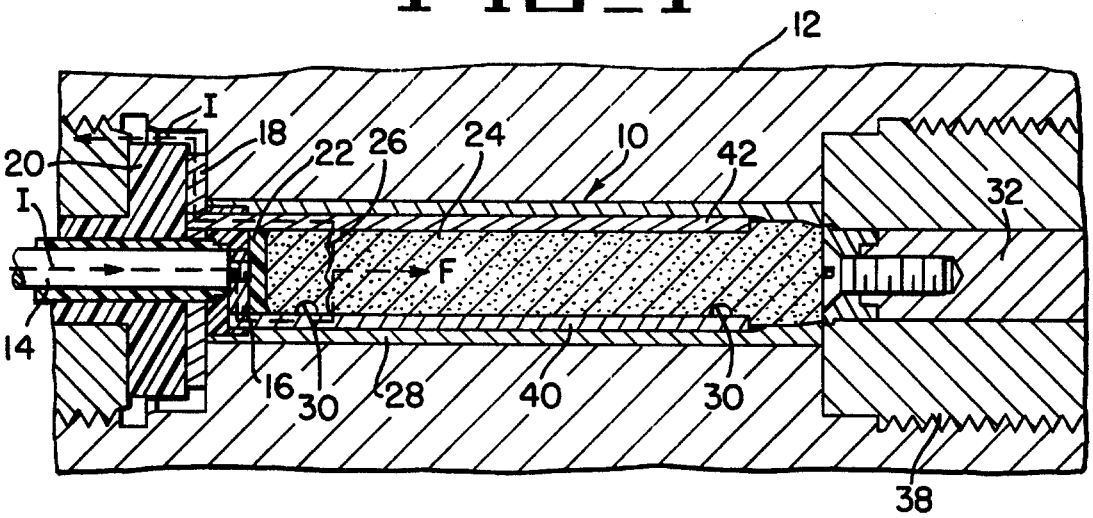
FIG. 1 is a central longitudinal section of the vectored plasma arc device disposed in a combustion chamber.

An exemplary embodiment of the vectored plasma arc device 10 is shown in FIG. 1. Device 10 is disposed in combustion chamber 12. Power rod 14 supplies power to device 10. Power rod 14 is connected to device 10 at power rail support 16. Power rod 14 is insulated and connects to device 10 at power rail support 16. The connection is made by passing power rod 14 through ground rail support 18, from which power rod 14 is isolated by means of typical insulation 20. End cap liner 22 isolates power rod 14 and power rail support 16 and ground rail support 18 from propellant 24 and fuse wire 26. Chamber liner 28 forms a barrier and isolates device 10 from the wall of combustion chamber 12. A plurality of transducers 30 are disposed between end cap liner 22 and projectile 32. Transducers 30 are not normally required but are used to take pressure readings as needed. Projectile 32 extends into gun tube 38. Power rail 40 and ground rail 42 are oriented parallel to each other as shown.

Figure 2:
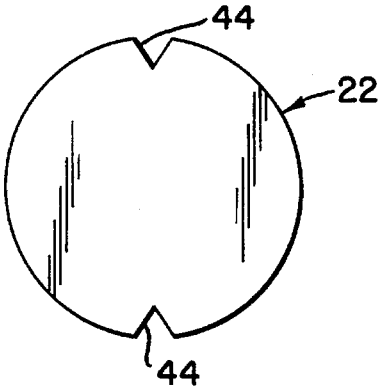
FIG. 2 is a front view of an end cap liner.

FIG. 2 shows end cap liner 22 and associated details. End cap liner 22 includes opposing grooves 44 which are used to support power rail 40 and ground rail 42 and enable connections to be made therethrough.

Figure 3:
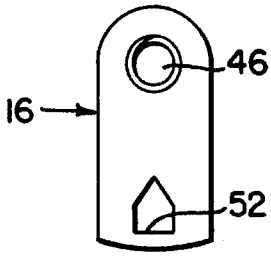
FIG. 3 is a front view of a power rail support.

Similarly, FIG. 3 shows power rail support 16. Connections to power rod 14 are made at power rod contact 46. Power rail 40 is connected at 52 thereby forming a power connection with power rod 14.

Figure 4:
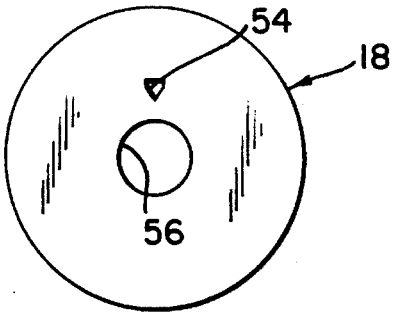
FIG. 4 is a front view of a ground rail support.

Referring now to FIG. 4, Ground rail support 18 is shown wherein ground rail 42 is connected at 54 and power rod 14 passes through at inlet 56.

The disclosure hereinabove relates to some of the most prominent structural features of the present invention. The operation and the cooperative aspects of structures, under a best mode scenario is described herein below.

Considering FIG. 1, sufficient power is supplied from a high energy source (not shown) to power rod 14. Current is transmitted to power rail 40. Fuse wire 26 connects power rail 40 to ground rail 42. Accordingly, the current "I" from power rail 40 flows through fuse wire 26 and ultimately travels to ground rail 42. Both power rail 40 and ground rail 42 are located against the wall of combustion chamber 12 and are electrically isolated from combustion chamber 12 by chamber liner 28. When high energy current passes through power rail 40 and ground rail 42, fuse wire 26 evaporates forming a plasma arc. Because of the structural organization and geometry of power rail 40 and ground rail 42 an electromagnetic force "F" is exerted on the plasma. The plasma which comprises ionized atoms and electrons responds to the electromagnetic force and is accelerated forward toward projectile 32. More importantly, the ionized plasma maintains current flow between power rail 40 and ground rail 42 because the plasma arc operates as a mobile conductive media therebetween. Further, propellant 24 which is stored between fuse wire 26 and projectile 32 is ignited as the arc travels down combustion chamber 12. Accordingly, the plasma arc which is accelerating under the influence of the electromagnetic forces "F" sweeps and pushes the ignited propellant 24 forward to follow projectile 32 down gun tube 38. One of the most significant advances proffered by the present invention is therefore the provision of efficient combustion and high pressure. Efficient combustion is provided as propellant is distributively and continually burned throughout the extent of combustion chamber 12 and ultimately through gun tube 38. High pressure is provided by means of the sustained and continuous near uniform burning of propellant throughout the acceleration length (i.e.. combustion chamber 12 ). Thus pressure is expansively and sustainably supplied down bore thereby creating constant pressure behind projectile 32. Consequently, very high muzzle velocities can be achieved with lower constant pressure. Various muzzle velocities may be achieved by varying the operational parameters. These parameters include, inter alia, the magnitude of the current, the distance between power rail 40 and ground rail 42, the viscosity of propellant 24 (if the propellant is a liquid), location and mass of fuse wire 26 and length of combustion chamber 12, and the length of rails 40 and 42 if they are extended into gun tube 38.

Accordingly, the structural organizations of the present invention particularly the parallel power rail 40 and ground rail 42 provide a significant advance over the prior art. Further, fuse wire 26 bridging and spanning between power rail 40 and ground rail 42 enables the integration of electro-thermal chemical process with electromagnetic technology. In the preferred embodiment, vectored plasma device 10 is constructed in a manner similar to an electro-thermal chemical gun cartridge. However, unlike an electro-thermal chemical cartridge, the present invention incorporates the rails. By positioning fuse wire 26 strategically, current "I" is established as far back from projectile 32 as feasible. This unique arrangement enables plasma generated by vaporizing fuse wire 26 to ignite propellant 24 at the farthest extremity behind projectile 32. One of the most unique aspects of the present invention is the use of electromagnetic forces "F", which are exerted on fuse wire 26 and ultimately on the plasma arc, to advance and distribute burning propellant down combustion chamber 12 and gun tube 38. The current path includes flow through power rail connection 52 (see FIG. 3) into power rail 40. From power rail 40, current "I" passes through fuse wire 26 and into ground rail 42. Hereafter, current "I" is grounded at ground rail connection 54 (see FIG. 4). The electromagnetic force "F" is perpendicular to the current "I". Although this force will change slightly as the arc moves down combustion chamber 12, it is considered to be constant, for most applications. As discussed hereinabove, the plasma arc comprises ionized atoms and electrons which conduct electric current "I". Accordingly, one of the most significant advances and advantages of the present invention is the use of the plasma arc as a mobile electromagnetic force to contain and sweep forward a burning propellant front, plasma and the attendant combustive constituents to thereby generate high muzzle velocity.

A simple model which assumes the plasma arc to be cylinderical in a stationary medium of given viscosity, constant current (i.e square pulse), constant magnetic field between the rails 40 and 42, and the drag on the arc to be compliant with Stoke's drag law, predicts the location of the arc as a function of time. The time that the arc takes to sweep the chamber is of the same order as the ballistic cycle. Therefore, it is feasible that the arc will push the propellant into the gun bore within the time scale of the projectile motion thus having a traveling charge effect.

Accordingly, the method and device disclosed in the present invention enables the creation of a traveling charge in which the fuel is not carried by the projectile but rather a resultant force, created from an electromagnetic field perpendicular to a current path, is used to accelerate a plasma arc. The plasma arc ignites and creates an advancing burning front thus yielding the equivalent of a traveling charge having directional and velocity magnitudes within the combustion chamber and the gun tube. Thus, the vectored plasma arc device disclosed herein enables the creation of much flatter pressure versus projectile travel curves than either conventional or electrothermal-chemical guns thus yielding high muzzle velocities.

While a preferred embodiment of the method and device of the present invention has been shown and described, it will be appreciated that various changes and modifications may be made therein without deputing from the spirit of the invention as defined by the scope of the appended claims.

What is claimed is:

1. A vectored plasma arc device in combination with a propellant, a combustion chamber, a gun tube and a projectile disposed therein comprising:

a power rod to supply power;

a plurality of extending rails comprising power rail and ground rail;

means for supporting said plurality of extending rails;

means for supporting said ground rail;

means for connecting said power rod to said plurality of extending rails;

end cap liner for isolating said power rod from said means for supporting said plurality of extending rails and said means for supporting said ground rail;

a fuse wire contiguous to said end cap and disposed within the propellant and connecting said ground rail to said power rail to thereby form a closed circuit; and a structure to contain said propellant, said power rod, said power rails, said means for supporting said plurality of extending rails, said means for supporting said ground rail, said end cap liner, said fuse wire and the propellant and said structure being separate and independent of the projectile disposed in the gun tube.

2. The device of claim 1 wherein said power rod is connected to said device at said power rail support.

3. The device according to claim 1 wherein said power rail and ground rail are located against a combustion chamber wall and are electrically isolated from said combustion chamber by an isolation liner means.

4. A device for combining electrothermalchemical and electromagnetic processes to accelerate a projectile in a gun tube comprising;

a power rod to supply power:

a plurality of extending rails comprising power rail and ground rail:

means for supporting said plurality of extending rails:

means for supporting said ground rail:

means for connecting said power rod to said plurality of extending rails;

end cap liner for isolating said power rod from said means for supporting said plurality of extending rails and said means for supporting said ground rail;

a propellant mass having a first and second ends and extending to the extent of said plurality of extending rails;

a fuse wire proximate to said end cap and disposed at said first end of said propellant mass and connecting said ground rail to said power rail to form a closed circuit; and a structure to contain said propellant, said power rod, said power rails, said means for supporting said ground rail, said end cap liner, said fuse wire and said propellant wherein said structure is separate and abuts against the projectile in the gun tube,

5. The device of claim 4 wherein said fuse wire is located at the farthest extremity of said propellant behind the projectile,

6. The device of claim 4 wherein current flow is maintained by said fuse wire and includes flow though said means for connecting said power rod into said power rail and ultimately to said ground rail.

7. A device for generating a mobile electromagnetic force to contain and sweep forward a burning propellant front behind a projectile in a gun tube to create high muzzle velocity Comprising:

a set of parallel rails having a first end and a second end comprising a power rail and a ground rail;

a fuse wire spanning between said parallel rails and disposed at said first end;

a projectile disposed at said second end of said set of parallel rails;

a propellant mass stored between said first end and said second end of said parallel rails;

a power rod to Supply power having a direct connection with one of said rails; and a structure to contain said rails, said fuse wire anal said propellant wherein said structure abuts said projectile in the gun tube.

8. The device of claim 7 wherein said fuse wire closes an electric circuit and provides a source of ignition for said propellant and further provides ionized plasma.

9. The device according to claim 7 further comprising acceleration, in a direction opposite current flow of ionized plasma formed from said fuse wire between said parallel rails to sweep burning propellant behind said projectile.

10. The device according to claim 7 wherein said structure forms a combustion chamber.

* * * * *